US006877949B2

(12) United States Patent
Cerruti et al.

(10) Patent No.: US 6,877,949 B2
(45) Date of Patent: Apr. 12, 2005

(54) PUMPING STAGE FOR A VACUUM PUMP

(75) Inventors: Roberto Cerruti, Turin (IT); Silvio Giors, Turin (IT)

(73) Assignee: Varian, S.p.A., Turin (IT)

( * ) Notice: Subject to any disclaimer, the term of this patent is extended or adjusted under 35 U.S.C. 154(b) by 0 days.

(21) Appl. No.: 10/429,811

(22) Filed: May 5, 2003

(65) Prior Publication Data

US 2003/0219337 A1 Nov. 27, 2003

(30) Foreign Application Priority Data

May 6, 2002 (IT) ..... TO2002A0370

(51) Int. Cl.[7] ..... F04D 5/00; F04D 19/04

(52) U.S. Cl. ..... 415/90; 415/55.1; 415/55.4; 415/55.6

(58) Field of Search ..... 415/55.1–55.7, 415/90, 143; 417/423.4

(56) References Cited

U.S. PATENT DOCUMENTS 5,358,373 A * 10/1994 Hablanian ..... 415/90
5,456,575 A 10/1995 Helmer et al.

* cited by examiner

*Primary Examiner*—Christopher Verdier
(74) *Attorney, Agent, or Firm*—Bella Fishman

(57) ABSTRACT

A pumping stage for a vacuum pump, has an improved geometry allowing an optimum trade-off to be achieved between the exhaust pressure and the pumping rate attained in that stage. In the pumping stage (1) the axial extension that is the height of the pumping channel (3) varies along the circumference of the channel (3) between the inlet port (13) and the outlet port (15).

18 Claims, 4 Drawing Sheets

PUMPING STAGE FOR A VACUUM PUMP

FIELD OF THE INVENTION

The present invention relates to a pumping stage for a vacuum pump. More specifically, the invention concerns a pumping stage for vacuum pumps of the kind known as turbomolecular pumps.

Particularly, the invention relates to a pumping stage with improved geometry allowing an optimum trade-off to be achieved between exhaust pressure and pumping rate in a turbomolecular pump.

BACKGROUND OF THE INVENTION

Generally, turbomolecular pumps comprise two different kinds of pumping stages in cascade.

A first group of stages, called turbomolecular stages, are located in the suction or high vacuum portion of the pump; such stages are configured to work at very low pressures, in molecular flow regime.

A second group of stages, called molecular drag stages, are located in the exhaust or "low" portion of the pump; such stages are configured to work at higher pressure, up to viscous flow conditions.

It is known that gas pumping molecular drag stages in turbomolecular pumps are generally obtained from the interaction between stator channels formed into the pump body, and rotor discs mounted onto an integral for rotation with a rotary shaft driven into rotation by the pump motor. Corresponding tangential flow pumping channels, into which gas flows to be exhausted by the pump are defined between stator channels and rotor disks.

Pumping channels communicate with each other through corresponding inlet and outlet ports, axially arranged such that the outlet port in one stage is aligned with the inlet port in a second, downstream stage.

Between the inlet and outlet ports, the pumping channels are circumferentially interrupted by a block or obstruction, also called a "stripper", generally formed in the stator channels, which provides for seal between inlet and outlet regions.

One of the problems encountered in developing a turbomolecular vacuum pump is the difficulty in exhausting gas to atmospheric pressure. When the pump cannot meet this requirement, generally a second pumping unit is provided at the outlet from the main pump, to allow attaining the desired pressure level.

Great efforts have been made in the past to obtain a turbomolecular pump capable of directly exhausting to atmospheric pressure, without need of providing a secondary pump.

More particularly, U.S. Pat. No. 5,456,575 assigned to Varian, Inc., discloses a pumping channel having a radial taper along its circumference, which taper allows increasing gas compression performance and extending the operating range of the turbomolecular pump.

Until now, generally only the possibility of varying the radial cross-section (or width) of the channel between the inlet and outlet ports has been considered, while leaving the axial cross-sectional size (or channel height) unchanged.

As known, the channel height is an essential parameter that significantly and differently affects important features, such as exhaust pressure and pumping rate of the pumping stage.

More particularly, in a molecular drag stage, the maximum exhaust pressure is inversely proportional to the square of the channel height. As a result, pumping channels are formed with the minimum possible height in order to obtain a high exhaust pressure.

On the contrary, pumping rate is directly proportional to the cross-sectional area of the channel inlet, hence to the channel height. This would lead to the contrary solution, i.e. to form pumping channels with a large height.

Thus, in the present turbomolecular pumps, in particular as far as the molecular drag stages are concerned, a trade-off must be found, by sacrificing the maximum exhaust pressure in favour of the pumping rate or vice versa.

It is a main object of the present invention to build a pumping stage for a turbomolecular pump allowing an optimum balance to be achieved between exhaust pressure and pumping rate.

It is another object of the present invention to build a molecular drag stage for a turbomolecular pump capable of exhausting gas to higher pressure than attainable by the conventional pumping stages.

It is a further object of the present invention to build a molecular drag pumping stage for a turbomolecular pump characterised by a lower energy dissipation in viscous flow than attainable by the conventional pumping stages.

The above and other objects are achieved by the pumping stage made in accordance with the invention, as claimed in the appended claims.

SUMMARY OF THE INVENTION

The pumping stage according to the invention is characterised by an axial taper, so as to allow keeping high the pumping rate, which depends on the cross-sectional area at the pumping stage inlet, and attaining a considerably higher exhaust pressure than attainable by using a channel with uniform height.

A number of embodiments of the invention will be disclosed in more detail with reference to the accompanying drawings, in which:

BRIEF DESCRIPTION OF THE DRAWINGS

Note that, in the Figures described hereinafter, parts or members with the same functions have been always denoted by the same reference numerals, even if they belong to different embodiments of the invention.

DETAILED DESCRIPTION OF THE INVENTION

Figure 1:
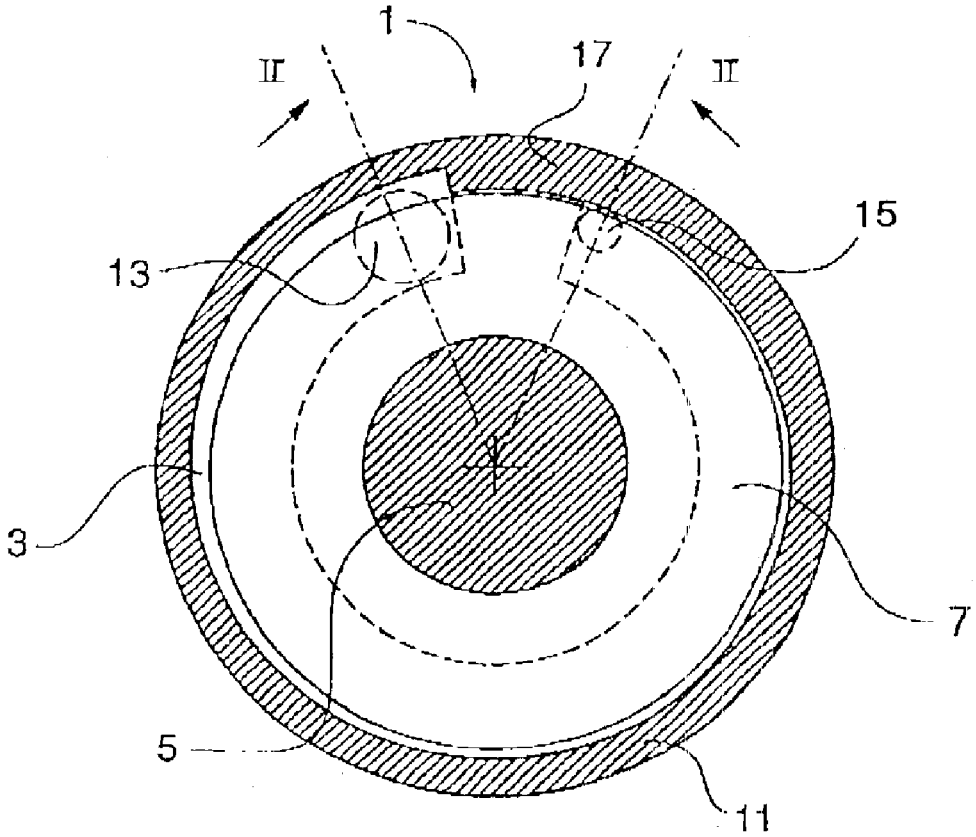
FIG. 1 is a top view of the pumping stage according to the preferred embodiment of the invention.
Figure 2:
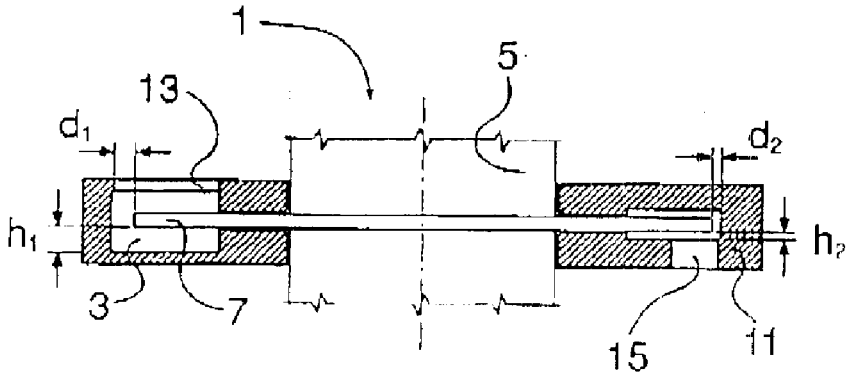
FIG. 2 is a schematical cross-sectional view, taken along line II—II, of the pumping stage shown in FIG. 1.
Figure 3:
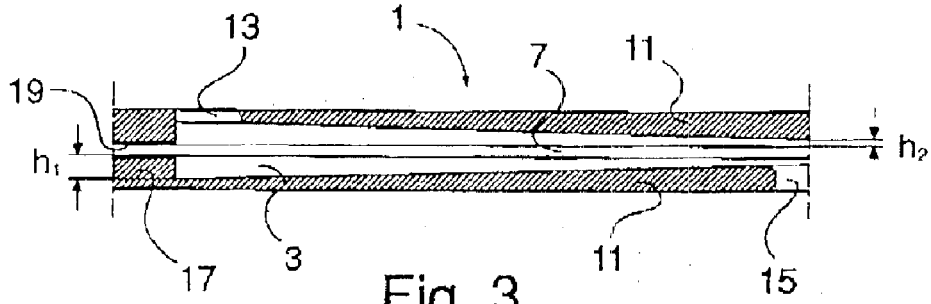
FIG. 3 is a schematical cylindrical cross-sectional view of the pumping stage shown in FIG. 1.

Referring to FIGS. 1 to 3, there is schematically shown a molecular drag pumping stage 1 according to the invention for a turbomolecular pump.

Pumping stage 1 is a so called molecular drag stage of the Gaede type, intended to be embodied into the pump downstream of the "high" or turbomolecular stages operating at lower pressures. The invention can however be applied to pumping stages having any kind of rotor discs, either equipped with vanes or smooth, as it will be explained in more detail hereinafter.

Pumping stage 1 embodies a tangential flow pumping channel 3, having a C-shaped cross section, defined between a rotor disc 7, fastened to shaft 5 rotated by the pump motor, and a stator ring 11 coupled with the pump body.

An inlet port 13, communicating with the pumping stage, if any, located upstream of stage 1 or with the suction port of the pump, provides for admitting gas into stage 1, and an outlet port 15 provides for exhausting gas from stage 1 towards the subsequent stage or the exhaust port of the pump.

A baffle or stripper 17 is located between ports 13 and 15 to provide for gas tightness between inlet and outlet regions of channel 3, through a reduced opening 19 of few tenths of a millimetre between the surfaces of the rotor disc and the stator.

Pumping channel 3 is radially tapered and has width $d_1$ at inlet port 13 and width $d_2$ at outlet port 15.

Advantageously, pumping channel 3 is also axially tapered: indeed, the axial distance between rotor 7 and stator 11 varies along the rotor circumference and decreases from a value $h_1$ at inlet port 13 of pumping stage 1 down to a value $h_2$ at outlet port 15 of said stage 1.

As better seen in FIG. 3, which is schematical cylindrical cross-sectional view of pumping stage 1, the pumping channel height progressively decreases along pumping channel 3 between inlet port 13 and outlet port 15.

It is to be appreciated that in the illustrated embodiment the height variation in pumping channel 3 has a linear shape, symmetrical with respect to the rotor disc.

Yet, a pumping stage with an axially tapered channel could also be provided in which the height of pumping channel 3 varies polynomially, exponentially or according to trigonometrically formula.

Figure 3A:
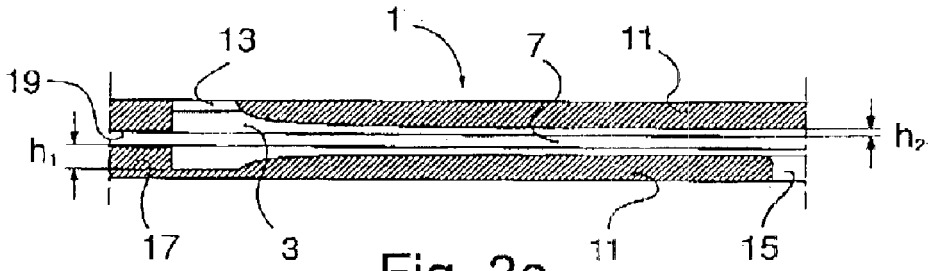
FIG. 3*a* is a schematical cylindrical cross-sectional view of a pumping stage according to a modified embodiment of the invention.

In this respect, FIG. 3*a* shows the development of a pumping stage 1 in which the height of pumping channel 3 decreases between inlet port 13 and outlet port 15 according to an exponentially shape.

Similarly, a pumping stage could be provided where the channel either is both axially and radially tapered, as in the illustrated embodiment, or is only axially tapered.

Still further, a pumping stage with a radially and/or axially tapered channel could also be provided, in which said variation is not symmetrical with respect to the rotor disc. In particular, the axial taper could be provided on one or the other disc side only.

As known, in case of pumping stages of large diameter, the channel length is excessive and it cannot be wholly exploited since, beyond a given limit distance, pumping becomes ineffective. Then, it is advantageous to divide the pumping stage circumference into two or more sections and to form as many pumping channels operating in parallel.

Figure 4:
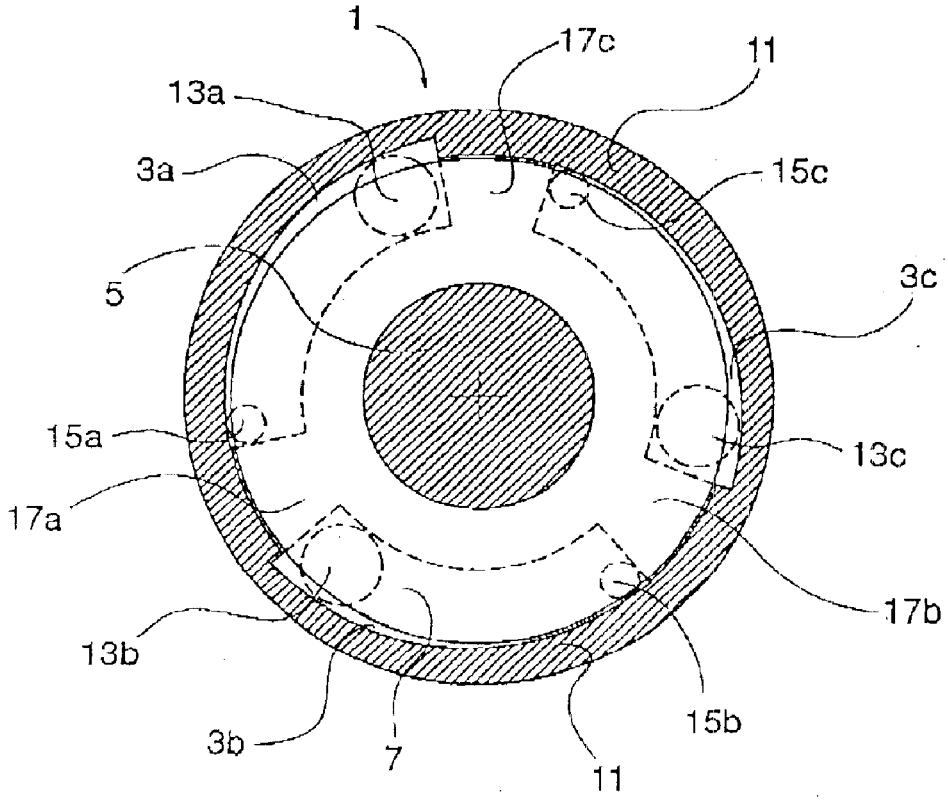
FIG. 4 is a top view of the pumping stage according to a second modified embodiment of the invention.

Referring to FIG. 4, a pumping stage 1 according to a second variant of the invention is shown. That variant is characterised by the presence of three pumping channels 3*a*, 3*b*, 3*c*. Each of these channels 3*a*, 3*b*, 3*c* includes a respective inlet port 13*a*, 13*b*, 13*c* and a respective outlet port 15*a*, 15*b*, 15*c*, the inlet ports communicating each with a corresponding channel in the upper stage and the outlet ports communicating each with a corresponding channel in the lower stage. A respective stripper 17*a*, 17*b*, 17*c* is provided at each respective outlet port 15*a*, 15*b*, 15*c* and separates the outlet port of one channel from the inlet port of the subsequent channel.

Figure 5:
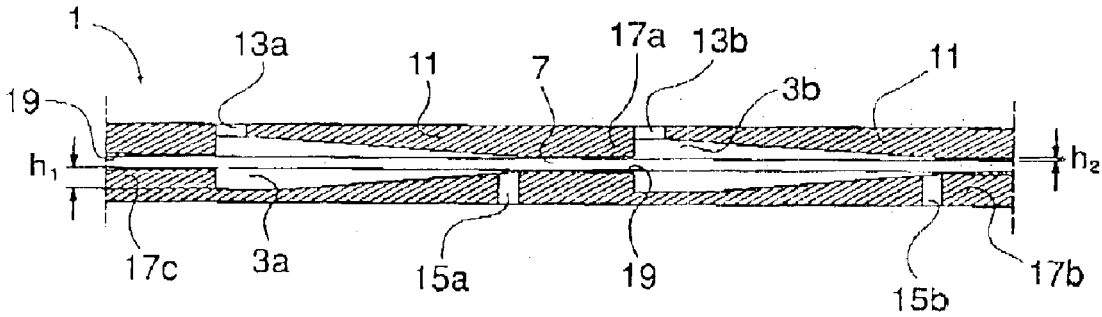
FIG. 5 is a partial and schematical cylindrical cross-sectional view of the pumping stage shown in FIG. 4.

As better seen in FIG. 5, which is a schematical cylindrical cross-sectional view of the pumping stage shown in FIG. 4, where only two of the three pumping channels operating in parallel are shown, the height of each respective pumping channel 3*a*, 3*b*, 3*c* progressively decreases between respective inlet port 13*a*, 13*b*, 13*c* and respective outlet port 15*a*, 15*b*, 15*c*, thereby conferring a saw-tooth circumferential profile to pumping stage 1.

Figure 6:
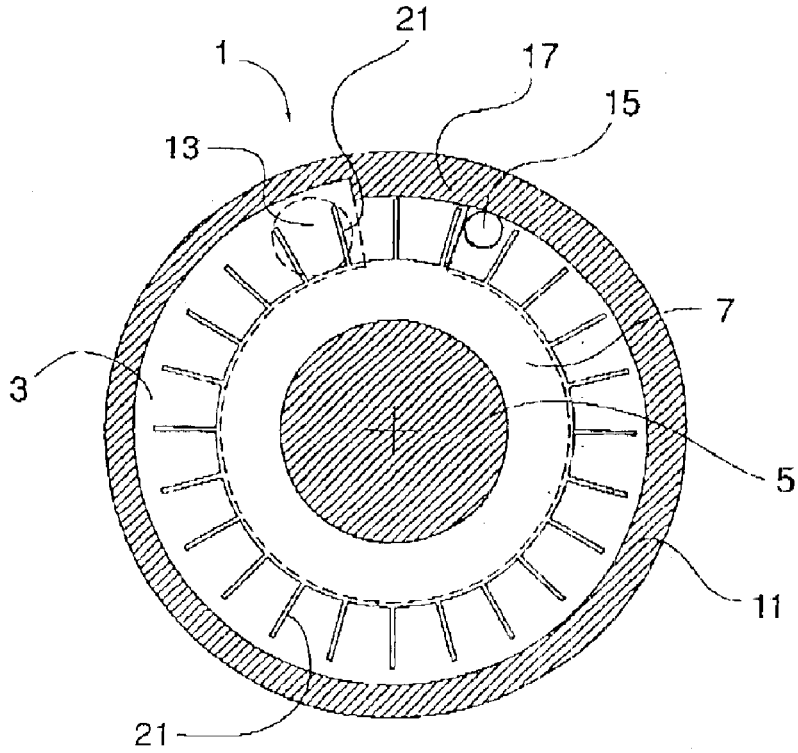
FIG. 6 is a top view of the pumping stage according to a third modified embodiment of the invention.

As stated before, the invention can be applied to any pumping stage equipped with a rotor disc. In particular, it can be applied to a pumping stage like that shown in FIG. 6, where rotor disc 7, instead of being smooth, has peripheral vanes 21 lying in planes perpendicular to the plane of rotor disc 7. Preferably, said vanes are uniformly distributed along the circumference of said disc 7. Using such a rotor disc results in a so-called "regenerative" pumping stage: thus, according to the invention, a regenerative pumping stage with axially tapered channel can be made.

According to the invention, in any variant thereof, the gas to be pumped enters pumping stage 1 through inlet port 13 and is compressed while travelling inside pumping channel 3 as far as to outlet port 15, through which the gas reaches the subsequent pumping stage or the exhaust port of the pump.

Figure 7:
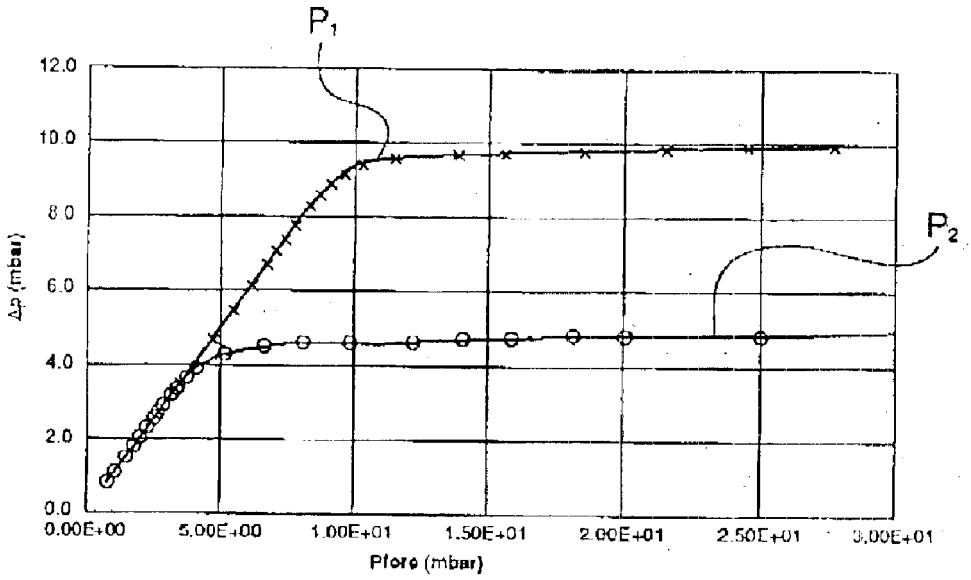
FIG. 7 is a graph showing the pressure difference as a function of the outlet pressure for a pumping stage according to the invention and a conventional pumping stage.

Referring now to FIG. 7, pressure difference $\Delta p$ achieved in the pumping stage between inlet and outlet ports 13, 15 is plotted versus exhaust pressure $p_{fore}$. In said Figure, the performance of a pumping channel according to the invention, with a linear radial and axial taper (line $P_1$), is compared with that of a pumping channel with uniform cross section (line $P_2$), said channels having the same height at the inlet port of the pumping stage.

As long as the pressure is below 4 mbar, in both cases pressure difference $\Delta p$ linearly increases as exhaust pressure $p_{fore}$ increases, and the two curves substantially overlap. When pressure $p_{fore}$ exceeds 4 mbar, a saturation phenomenon takes place in the uniform height channel and pressure difference $\Delta p$ keeps constant. On the contrary, in case of the axially tapered channel, the linear increase in pressure difference $\Delta p$ as a function of pressure $p_{fore}$ continues, approximately with the same slope, and saturation occurs at a much higher value of $p_{fore}$, about 10 mbar, and at a value of pressure difference $\Delta p$ that is about 2.5 times the saturation value for the uniform height channel.

Figure 8:
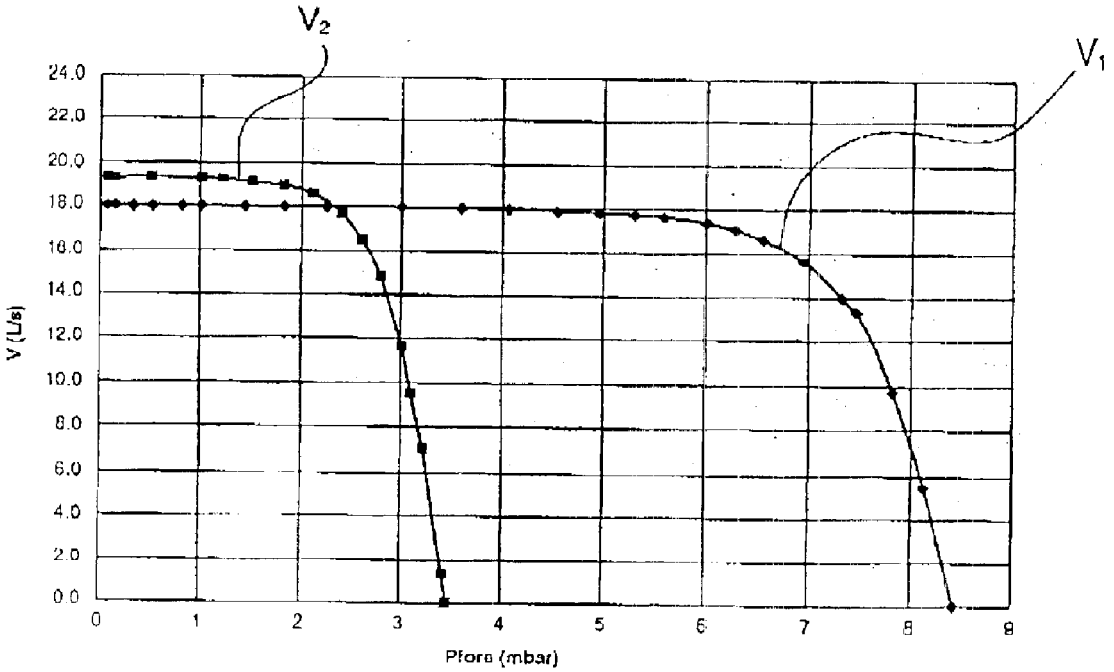
FIG. 8 is a graph showing the pumping rate for a pumping stage according to the invention and a conventional pumping stage.

FIG. 8 is a graph showing pumping rate V of the pumping stage as a function of exhaust pressure $p_{fore}$, the inlet pressure being constant. Also in this Figure the performance of a pumping channel according to the invention, with a linear radial and axial taper (line $V_1$) and that of a pumping channel with uniform cross section (line $V_2$) are compared, said channels having the same height at the inlet port of the pumping stage.

When the values of pressure $p_{fore}$ are very low, below 2 mbar, pumping rate is slightly higher in the pumping channel with uniform cross section. Yet, for the pumping channel with uniform cross section, when pressure $p_{fore}$ exceeds 2 mbar, pumping rate rapidly decreases. On the contrary, in case of the tapered pumping channel, pumping rate keeps constant up to values of $p_{fore}$ close to 6 mbar.

The graphs of FIGS. 7 and 8 clearly show the advantages in terms of higher exhaust pressure and higher compression ratio afforded by the invention with respect to the traditional channel, the axial and radial size being unchanged.

Moreover, the axial taper of pumping channel 3 helps in reducing power dissipation, thanks to the higher performance in terms of compression and to the lower tendency to turbulence, what can be expressed by a better control over Reynolds number $$\mathrm{Re} = \frac{\rho V h}{\eta}$$

where

ρ=density of the gas being pumped

V=average gas velocity in the pumping channel h=channel height

η=viscosity of the gas being pumped.

Actually, Reynolds number is proportional to the pumping channel height and the variation of said height along pumping stage 1, in particular the height decrease as pressure increases along pumping stage 1, ensures a better control over Reynolds number, especially in case of pressure values exceeding 10 mbar, that is, for pressure values at which the turbulence effects can become important.

What is claimed is:

1. A pumping stage of turbomolecular vacuum pump comprising:

a rotor disc coupled to a rotatable shaft;

a stator ring disposed around said rotor disk;

at least one gas pumping channel being defined between said rotor disc and said stator ring, said pumping channel having an inlet and an outlet port for respectively admitting thereto and exhausting therefrom a gas flow, wherein a height of said pumping channel measured as its axial extension being decreased along a circumference of said pumping channel between said inlet and outlet ports.

2. The pumping stage of claim 1, wherein a distance in an axial direction between said rotor disc and said stator ring varies between said inlet port and said outlet port relative to at least one plane of said rotor disc.

3. The pumping stage of claim 1, wherein the height of said pumping channel varies relative to both planes of said rotor disc, symmetrically with respect to said rotor disc.

4. The pumping stage of claim 2, wherein the height of said pumping channel decreases between said inlet port and said outlet port.

5. The pumping stage of claim 2, wherein the height of said pumping channel varies between said inlet and outlet ports according to a linear function.

6. The pumping stage of claim 2, wherein the height of said pumping channel varies between said inlet and outlet ports according to a polynomial function.

7. The pumping stage of claim 2, wherein the height of said pumping channel varies between said inlet and outlet ports exponentially.

8. The pumping stage of claim 2, wherein the height of said pumping channel varies between said inlet and outlet ports according to trigonometric functions.

9. The pumping stage of claim 2, wherein a distance between said rotor disc and said stator ring in radial direction, varies along the circumference of said pumping channel between said inlet port and said outlet port.

10. The pumping stage of claim 9, wherein said distance between said rotor disc and said stator ring and said height of said pumping channel have the same maximum values at the inlet port, and the same minimum values at the outlet port and vary along the circumference of said pumping channel according to the same mathematical function.

11. The pumping stage of claim 1, further comprising two or more pumping channels working in parallel, each having an inlet port, an outlet port and a stripper separating the outlet port of one channel from the inlet port of the subsequent channel, wherein the height of each said pumping channel decreases between the inlet port and the outlet port according to the same mathematical function.

12. The pumping stage of claim 11, wherein said rotor disc is equipped with peripheral vanes, which extend in planes perpendicular to a plane of said rotor disc and are preferably uniformly spaced along the rotor disc circumference.

13. The pumping stage of claim 1, comprising a C-shaped cross section, said inlet port and said outlet port are located on opposite sides of said rotor disc.

14. A turbomolecular vacuum pump with a plurality of vacuum pumping stages disposed between an inlet and an outlet of a pump body, each having a rotor disc and a stator ring, comprising:

at least one vacuum pumping stage of said plurality comprising at least one gas pumping channel formed between said rotor disc and stator ring, wherein a height of said at least one gas pumping channel measured as its an axial extension being decreased along a circumference of said pumping channel between said inlet and outlet ports.

15. The turbomolecular pump of claim 14, wherein a distance between said rotor disc and stator ring is decreased along the circumference of said pumping channel between said inlet and outlet ports, said height and said distance are decreased along the circumference of said pumping channel according to the same mathematical law.

16. The turbomolecular pump of claim 15, wherein said at least one vacuum pumping stage comprises two or more pumping channels working in parallel, and a stripper separating an outlet port of one pumping channel from an inlet port of a subsequent channel.

17. The turbomolecular pump of claim 16, wherein said plurality of vacuum pumping stages comprising:

a first group of vacuum pumping stages having pumping stages with an axially tapered gas pumping channels, said first group is disposed proximate to the inlet of said pump body that is capable of working in molecular flow regime, and a second group of vacuum pumping stages comprises pumping stages with axially tapered channels, said second group is located downstream of said first group proximate to the outlet of said pump body, that is capable of exhausting gas to a pressure at least close to atmospheric pressure.

18. The turbomolecular pump of claim 17, wherein at least one of the pumping stages with an axially tapered channel comprises a rotor disc equipped with peripheral vanes lying in planes perpendicular to the plane of said disc and preferably uniformly spaced along the disc circumference.

* * * * *